US005608924A

United States Patent [19]

Antunez

[11] Patent Number: 5,608,924

[45] Date of Patent: Mar. 11, 1997

[54] CONSISTENT DELIVERY FLUSH AND FILL SYSTEM FOR A TANK

[76] Inventor: Bruce A. Antunez, 1143 Indian Springs, Glendora, Calif. 91740

[21] Appl. No.: 420,002

[22] Filed: Mar. 24, 1995

[51] Int. Cl.[6] ..... E03D 1/34

[52] U.S. Cl. ..... 4/391; 4/366; 137/391

[58] Field of Search ..... 4/366, 378, 390, 4/391, 367, 381; 137/391, 398

[56] References Cited

U.S. PATENT DOCUMENTS

| | | | |
|---|---|---|---|
| 3,596,293 | 7/1970 | Thomas | 4/391 |
| 4,601,071 | 7/1986 | Persson | 4/333 |
| 4,615,056 | 10/1986 | Grant | 4/366 |
| 5,464,037 | 11/1995 | Yoanes | 4/366 X |

FOREIGN PATENT DOCUMENTS

| | | | |
|---|---|---|---|
| 0201895 | 12/1938 | Switzerland | 4/391 |

*Primary Examiner*—Charles E. Phillips
*Attorney, Agent, or Firm*—Donald D. Mon

[57] ABSTRACT

A consistent-delivery flush and fill system for a water tank. A vertically movable post with a central passage carries a valve plug to open and close a valve seat for a discharge port from the tank. Buoyancy means on the post respond to the water level in the tank. A tank valve supplies water to the tank. When the tank is full the tank valve is closed. Engagement means on the post prevents the tank valve from opening until the tank is substantially emptied, at which time the valve plug closes the discharge port and enables the tank valve to open, having delivered a substantially constant volume of water from flush-to-flush.

8 Claims, 2 Drawing Sheets

CONSISTENT DELIVERY FLUSH AND FILL SYSTEM FOR A TANK

FIELD OF THE INVENTION

A flush and fill system for a water storage tank which delivers consistent volumes of water per flush over a wide range of water supply pressures and supply rates.

BACKGROUND OF THE INVENTION

The environmental concerns regarding availability of water for any purpose, especially for sewage disposal, and of disposing of water used for sewage purposes, has led to severe limitations on the amount of water which is permitted for each flush of a commode. Historically commode flushing systems were permitted to use whatever amount of water was convenient to flush the commode and reliably remove the contents of the bowl. Cycles using several gallons were acceptable.

Now that has profoundly changed. In certain areas crowded with people, the resulting demand for water and the amount of effluent they generate seriously compromise the availability of the water and of the disposal plants which ultimately receive it. As a consequence, governmental units regularly require that new commode installations be reliably flushed with only a few quarts of water, instead of gallons.

A properly designed commode can indeed flush reliably with such a short flush, but only if it is reliably supplied, each time, with a known and specified volume of water delivered under known and specified conditions. However, conventional commode supply and flush systems are susceptible to substantial variations not only from installation to installation, but from flush to flush in the same installation. This makes it most difficult for a manufacturer to design a product for a short flush which is reliable under all circumstances.

It is an object of this invention to provide a flush and fill system for a commode tank whose delivery is volumetrically consistent regardless of differences or variations in water supply pressure or re-supply rates of flow.

In the conventional art, a commode tank is filled and kept closed and at rest until a flush cycle is started. When it is, a flush valve in the bottom of the tank is opened and the contents of the tank are discharged into the commode. The problem arises that with a conventional float-controlled supply valve, the supply valve opens to re-supply the tank even while the tank is emptying, because the float valve which follows the surface of the water in the tank as the tank empties opens the valve before the tank is emptied.

Such an arrangement is tolerable if one can assume that the flow rate of re-supply is consistent and known relative to the rate of discharge from the tank to the commode. This is far from a reliable assumption. Especially for short flushes, variations in water supply pressures and related flow rates can cause the amount of water actually delivered in a given period of time to vary as much as 30% above and below that which is needed for an optimum flush. Such variations either way from an optimum flush are undesirable. Too little water can make an insufficient flush, which will require a subsequent flush thereby wasting water. Too much wasted water frustrates the very purpose of having a short flush commode in the first place.

This invention overcomes the disadvantages of the prior art by requiring that the contents of the tank at rest be delivered to the commode before refilling of water to the tank is started. Deferral of refilling is not per sea new concept. For example, see Antunez U.S. Pat. No. 4,840,196 issued Jun. 29, 1989. However the invention contemplated in that patent involves a complexity of valving concepts which it is an object of this invention to overcome, and which will permit the use of known and proved conventional tank valves.

BRIEF DESCRIPTION OF THE INVENTION

A flush and refill system according to this invention is fitted into a water tank. The water tank has an outlet port with a flush valve seat in it that is adapted to be opened and closed by a flush valve plug mounted to a vertically extending post. Buoyancy means is provided for this post. This post may, if desired, also function as an overflow pipe that is open at its top and bottom, with its lower end discharging into the outlet port. Optionally it may instead be a closed post which together with the flush valve plug and buoyancy means will be buoyant when not forced against the valve seat. In any event, the post has an engagement surface that moves vertically as a part of the post when the post moves up and down.

A level responsive water supply valve receives water under system pressure for refilling the tank. It includes level responsive means such as a float on a float arm. When the water in the tank reaches a storage level, the float and its arm will shut off incoming water. When the water level lowers after the flush valve is opened, then if the float is permitted to lower, the valve will open to refill the tank.

According to a feature of this invention, when the post is raised to open the flush valve, it also rises to prevent the supply valve from opening so long as the post is sufficiently buoyant, i.e., when there is sufficient water in the tank to hold the post in a sufficiently elevated position such that the water supply valve will be restrained to its upper, closed position.

When sufficient water has left the tank, the flush valve will close, and the post will lower to permit the supply valve to open. Notice that the resupply of the tank cannot start until the tank is substantially empty.

According to a preferred but optional feature of this invention, the water supply valve is a conventional float activated ballcock valve and the post serves to prevent the lowering of its float until after the discharge of water from the tank is substantially complete.

According to a preferred but optional feature of the invention, the post is open at both of its ends. A peripheral enlargement in its mid-length will constitute the buoyant means while the passage through the post is not flooded.

According to an optional feature of the invention, the post may instead control an off-on valve in series with the ballcock valve to prevent flow therethrough while the tank water level is lowering from its full to its empty level.

The above and other features of this invention will be fully understood from the following detailed description and the accompanying drawings, in which:

DETAILED DESCRIPTION OF THE INVENTION

Figure 1:
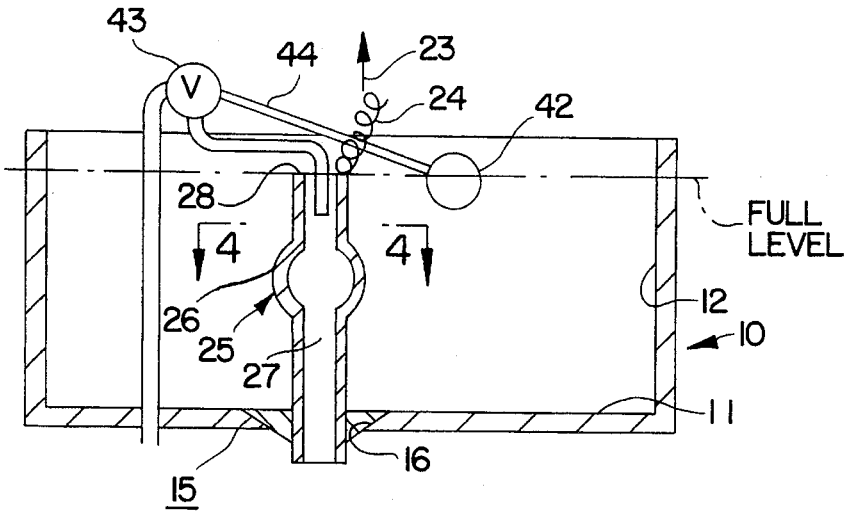
FIG. 1 is a vertical cross-section partly in schematic notation showing the presently-preferred embodiment of the invention in its storage condition.
Figure 2:
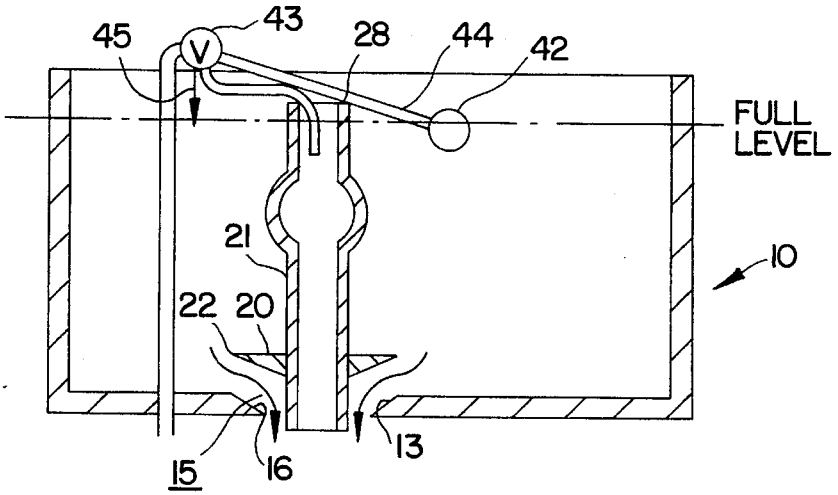
FIG. 2 is a view similar to FIG. 1 showing the invention in its flushing condition.
Figure 3:
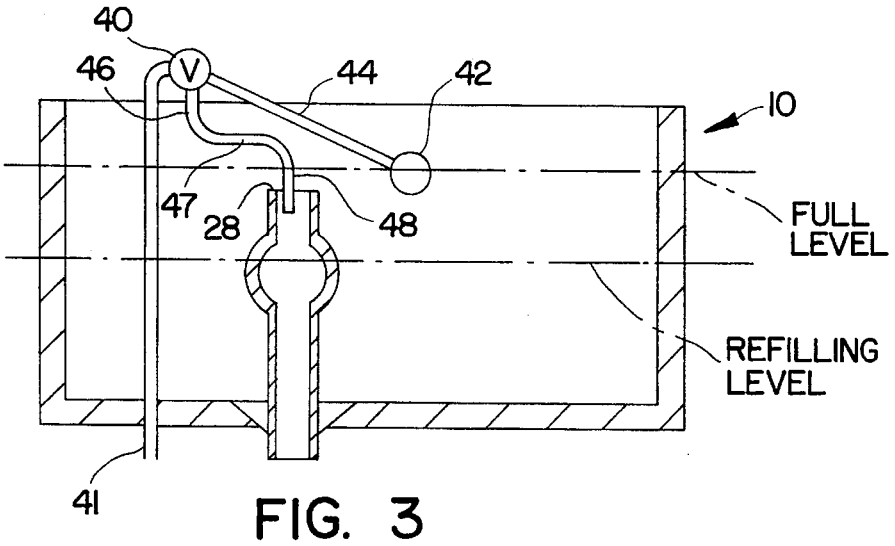
FIG. 3 is a view similar to FIG. 1 showing the invention in its refilling condition.
Figure 4:
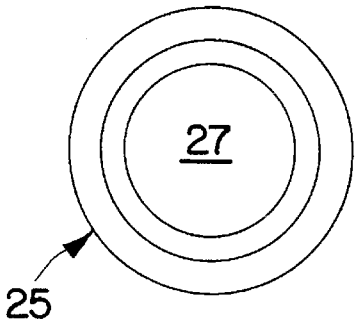
FIG. 4 is a cross-section taken at line 4—4 in FIG. 1.

The invention will best be understood from an examination of FIGS. 1–3, which show a sequence from storage (FIG. 1), through flush discharge (FIG. 2), through tank refilling (FIG. 3), after which the stored condition of FIG. 1 will resume.

The system is installed in a water tank 10 having a bottom 11 and a peripheral sidewall 12. An outlet port 13 is formed on the bottom, through which water will be discharged into the commode (not shown). A flush valve 15 is fitted in the outlet port. It includes a tapered valve seat 16, mounted to a conventional spud (not shown), in accordance with known arrangements.

A valve plug 20 is fitted to a post 21. The plug has a valve face 22 tapered downwardly to match valve seat 16 in order to close the flush valve. As shown by arrow 23, a chain 24 is fastened to the post to lift it to start a flush cycle. The chain will be coupled to a conventional pivoted handle and arm for the purpose of lifting the post.

Figure 6:
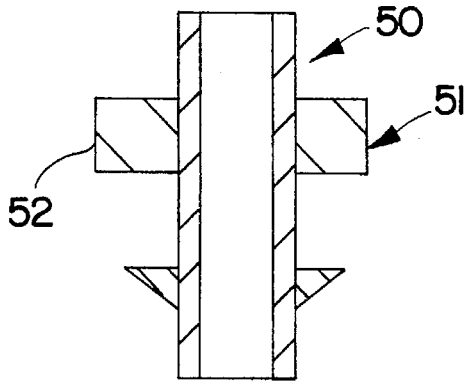
FIG. 6 is a cross-section showing another embodiment of buoyant means.

Buoyancy means 25, such as an enlarged medial portion 26 of the post is incorporated in the post. The post includes a central passage 27 open from top to bottom. The medial portion is enlarged internally and externally, and is ring-like. The weight of the post, of the valve plug and of the buoyancy means (if a separate buoyancy means is used as shown in FIG. 6) relative to the buoyant effect of the buoyancy means is selected so that when the valve plug is separated from the valve seat, the post will rise, and can exert enough upward force to accomplish the delay to be described below. This assembly will usually be quite light in weight.

In its preferred form, the post will be a hollow tube, open at its upper and lower ends. It can thereby function as an overflow pipe for the tank when the flush valve is closed. If preferred, an overflow pipe can be supplied separately, and the post may be a closed rod. However the post is made, it will include an engagement surface 28, preferably at the upper end of the post, for a purpose next to be described.

A tank valve 40 is fitted in the tank and connected to a source of water under pressure from a supply pipe 41. Many kinds of valves may be used, but a conventional float-controlled ballcock valve of the type shown in Autunez U.S. Pat. No. 3,389,887, issued Jun. 25, 1968 is especially useful. The details of such a valve are very well known and need no description here. Reference may be had to this Antunez patent for further details.

The valve is controlled by a float 42 pivotally mounted to the valve body 43 by an arm 44. At the upper position shown in FIG. 1, the valve is closed to flow. Below this position (FIG. 3) the valve is open to flow. The valve discharges water into the system in two ways. The first is through a supply outlet 45, directly into the tank, and the other is through a bowl refill tube 46.

The bowl refill tube is intended to deliver a minor amount of water to the bowl after the major flush discharge to provide a gas seal in the bowl. This is a known arrangement. This tube may be made quite rigid and can be attached to valve body 43. It includes a bend 47 and a depending length 48 which extends downwardly into the post to stabilize the post against excessive wobbling. It is long enough to remain in the post in all of the post positions without impeding the vertical movement of the post.

The operation of this system will be understood from the foregoing. When the system is in its rest, stored, condition (FIG. 1) with the tank full to its full level, the flush valve remains closed, because the buoyancy of the buoyancy member will be overcome by the downward differential pressure on the valve plug (the water pressure above it, versus the atmospheric pressure beneath it.)

To start a cycle, the chain is pulled up to separate the valve plug from the valve seat. This terminates the net force holding the flush valve closed, and the buoyancy means quickly raises the post to the position shown in FIG. 2. Then the engagement surface engages the float arm and holds it at or above the level at which the tank valve can open. In fact, it might raise the float above its rest level.

This condition continues until the water level in the tank falls below the buoyancy means. Then the post will drop (FIG. 3) and the flush valve will close. This enables the tank valve to reopen and resupply the tank with water.

The post shown in FIGS. 1–3 is interesting in its performance. Simply placed in a pool of water, it will sink, and will have no buoyant property. Assume now that it is closed at its lower end. Then it would be buoyant because there is no water in it.

Next, assume that the lower end is exposed only to air and not to water. Then, because of the radial enlargement it will be buoyant, and will remain buoyant until the passage is flooded. This circumstance exists immediately after the post is raised.

While the post is closed on the valve seat, the passage drains down out into the flow channels to the bowl. It is filled with air, because these flow channels are vented.

When the post is pulled upwardly, water from the tank rushes through the valve seat. This is its preferred flow path, and water will not back up into the post passage. When the water level lowers sufficiently, the valve plug will close the valve seat, but then buoyancy is meaningless, because water will flood the top side of the valve plug, and overcome any buoyancy of the post.

This is a surprisingly simple post construction. In a field where savings of fractions of cents can contribute to the attractiveness of a product, this is a considerable advantage.

FIG. 6 shows another embodiment of a post 50, in which separate buoyancy means 51 is attached to the post. Preferably it will be a ring 52 of foam plastic material which can be slided up and down the post to establish the level at which the post is to lose its buoyant property.

It should be noted that the tank valve will have remained closed during almost the entire period in which the tank was emptying. No replacement water was supplied during this time. Therefore the flush cycle will have delivered an exact amount of water under flow conditions entirely determined by the geometry of the tank, and independent of the time it takes to refill the tank. Further, the time-rate of water discharge from the tank is entirely determined by the geometry of the commode installation. Both time and volume of each flush are remarkably consistent, and also consistent between different installations of the same design.

Figure 5:
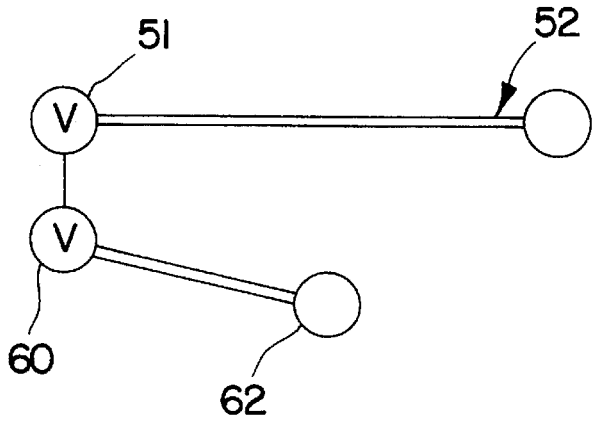
FIG. 5 is a top view, partly in schematic notation, showing another embodiment of the invention.

The engagement means on the post shown in FIGS. 1–3 are intended to engage either the float arm or an extension from it. It may be preferred to have the post react with a lighter-weight device effective on the tank valve not directly, but in series with it. FIG. 5 schematically shows the same kind of tank valve 51 as in FIGS. 1–3, but which is not reacted by the post. It is controlled in part by a float and arm 52. Instead, a control valve 60 is plumbed into the supply line ahead of tank valve 51. It is an off-on valve under control of a control arm 52 that reacts with post 62. When the post is in its upper position as in FIG. 2, it will raise the control arm and close valve 60 which prevents flow through valve 51 regardless of the position of the float.

When the post lowers and the flush valve is closed the control arm will move downwardly and enable the tank valve to supply water so long as the float is below the storage level. While useful, this arrangement does involve an additional valve and will rarely be preferred.

This invention is not to be limited by the embodiments shown in the drawings and described in the description, which are given by way of example and not of limitation, but only in accordance with the scope of the appended claims.

I claim:

1. A water storage and delivery system for a commode comprising:

a water tank having a bottom, a peripheral sidewall, and an outlet port through said bottom;

a flush valve fitted in said outlet port, said flush valve including a peripheral valve seat and a valve plug having a seat complementary to said valve seat to close said flush valve when said seats are in abutment;

a vertically movable post to which said valve plug is attached, said post including engagement means and a center passage;

buoyancy means on said post;

a tank valve in said tank receiving water under system pressure, said tank valve including a supply outlet to supply water into said tank;

a float in said tank floatable in said water and linked to said tank valve, whereby when the float is at an upper water storage level the tank valve is closed, and when it is below said upper water storage level, said tank valve is open;

said buoyancy means is selected so that when said valve plug is separated from said valve seat, said post will rise causing said engagement means to bear supportively upwardly on said float from below to hold the float in an upper position wherein the tank valve is closed, and which, when the post is not buoyantly floating as the consequence of closure of the flush valve, said engagement means is separated from said float to permit said float to move below said upper water storage level and permit said tank valve to open and fill the tank.

2. A system according to claim 1 in which said buoyancy means is a float attached to said post.

3. A system according to claim 1 in which said post is a hollow overflow tube open at both of its ends.

4. A system according to claim 3 in which said buoyancy means is an integral ring-like enlargement of said post, to form a hollow bulge that extends radially outwardly both inside and outside of the passage, and is a continuous closed surface from top to bottom.

5. A system according to claim 4 in which said tank valve further includes a bowl refill line, said line extending from said tank valve into the upper end of said passage to permit vertical movement of the post and to limit its lateral movement.

6. A system according to claim 1 in which said float is coupled to said tank valve by a float arm, said engagement means engaging said float arm to resist lowering of the float when the post itself is buoyantly elevated.

7. A system according to claim 6 in which said tank valve further includes a bowl refill line, said line extending from said tank valve into the upper end of said passage to permit vertical movement of the post and to limit its lateral movement.

8. A system according to claim 1 in which a second tank valve includes valve means connected in series with said first-named tank valve, said second tank valve including float means responsive to the water level in the water tank which will permit flow of water to the tank whenever the level is below the storage level, said first named tank valve being responsive to said post, whereby to make water available to said second tank valve only when said valve plug is lowered to close the valve seat.

* * * * *